United States Patent [19]

Taylor

[11] 4,351,439

[45] Sep. 28, 1982

[54] MERCHANDISE DISPLAY DEVICE

[75] Inventor: William B. Taylor, Chamblee, Ga.

[73] Assignee: Leggett & Platt, Incorporated, Carthage, Mo.

[21] Appl. No.: 129,341

[22] Filed: Mar. 11, 1980

[51] Int. Cl.[3] ..... A47F 5/00

[52] U.S. Cl. ..... 211/49 D; 211/43

[58] Field of Search ..... 211/49 D, 43; 185/37, 185/39; 160/301

[56] References Cited

U.S. PATENT DOCUMENTS

| | | | |
|---|---|---|---|
| 507,747 | 10/1893 | Nisbet | 160/301 |
| 1,283,599 | 11/1918 | Thomas | 185/37 |
| 1,395,825 | 11/1921 | Hoffman | 211/43 |
| 2,738,881 | 3/1956 | Michel | 211/49 D |
| 2,934,212 | 4/1960 | Jacobson | 211/49 D |
| 3,007,580 | 11/1961 | Dickson | 211/49 D |
| 3,161,295 | 12/1964 | Chesley | 211/49 D |
| 3,166,195 | 1/1965 | Taber | 211/49 D |
| 3,308,961 | 3/1967 | Chesley | 211/49 D |
| 3,848,745 | 11/1974 | Smith | 211/49 D |
| 4,128,177 | 12/1978 | Bustos | 211/49 D |
| 4,238,022 | 12/1980 | Williams | 211/49 D |

*Primary Examiner*—Reinaldo P. Machado
*Attorney, Agent, or Firm*—Wood, Herron & Evans

[57] ABSTRACT

A display device for feeding a column of objects forwardly on a shelf as the forwardmost objects are removed. The device comprises a bracket adapted to be secured to the front of the shelf and a flexible belt wrapped around a roller rotatably mounted within the bracket. Preferably, a low friction surface tape is secured to the top surface of the shelf over which the belt is movable. The device contains a torsion spring for maintaining a forward feed bias on the belt and a mechanism for adjusting the tension on the spring so as to vary that spring bias to enable the device to forward feed differing size and weight objects.

14 Claims, 6 Drawing Figures

MERCHANDISE DISPLAY DEVICE

The present invention relates to a merchandise display device, and more particularly to a device for automatically moving merchandise forwardly on a shelf as the forwardmost objects are removed so as to maintain the merchandise at the forefront of the shelf.

In retail merchandising, it is desirable to maintain displayed articles at the forefront of a display shelf. This stems from the fact that as shoppers or purchasers remove items from the front of a shelf, they thereby establish a gap at the front of the shelf and make it more difficult to reach behind that gap and grasp the next following article. It is now well documented that the sale of objects from a display decreases as the size of the gap between the front of the shelf and the first object increases. Consequently, it is common for employees of a merchandising establishment to periodically move all of the merchandise on a shelf forwardly so as to establish the forwardmost object in a row of objects at the front of the shelf. This, though, requires a very substantial investment of employee time and labor in periodically moving the objects on the shelf.

To eliminate that employee time and labor, it has been proposed to mount display devices upon the shelves which effect automatic forward movement of the objects on the shelf as the forwardmost object is removed. Examples of such automatic forward feed display devices may be found in U.S. Pat. No. 3,166,195 to Tabor, or U.S. Pat. No. 3,007,580 to Dickson. In general, most of the forward feed devices of the prior art though have been commercial failures, usually because the cost of the devices exceeded their value in increased sales and labor savings, and because the devices were so limited in application, i.e., they could accommodate and effectively be used with only one size and weight object. Recently, there has been developed and placed in commercial use by the assignee of this application, an endless belt type of forward feeding device in which the belt is mounted on an angle and utilizes gravity to move objects forward over a relatively friction free surface as objects are removed from the shelf. This device is described in U.S. Pat. No. 4,128,177. While the device of this patent has met with commercial acceptance, it too has its inherent limitations. Specifically, it requires that the objects be located on a sloping surface rather than a horizontal one and it cannot be conveniently retrofitted or added to an existing horizontal shelf so as to convert that shelf from a display surface to a self-feeding display shelf.

It has therefore been an objective of this invention to provide a forward feeding device which may conveniently be added to or retrofitted onto a horizontal shelf to thereby convert that shelf from a simple display shelf to a shelf-feeding display shelf.

Another object of this invention has been to provide a self feeding device in which displayed objects are mounted upon an automatic forward feed display belt, the forward feed force of which may be varied or adjusted to accommodate different size and weight objects upon the belt.

The display device of this invention which accomplishes these objectives comprises an attachment which is adapted to be adhesively secured to the front of a shelf and which includes a roller around which there is wrapped a flexible belt. That belt has an abutment plate secured to its outer end such that as objects are placed upon the belt, the belt is pulled out from the roller. There is a torsion spring operable to effect automatic return of the belt onto the roller and additionally there is an adjustment knob located on the side of the roller support bracket for adjusting the tension of that torsion spring. By adjusting that spring, it is possible to vary the forward feeding force of the spring so as to accommodate differing size and weight objects upon the belt. Preferably, there is a low friction surface upon the underside of the belt or secured to the top surface of the shelf so as to facilitate movement of the belt over the shelf surface.

The primary advantage of this invention is that it may be easily retrofitted onto existing display shelves so as to convert those shelves to self-feeding display shelves. Additionally, this invention has the advantage of including a mechanism for adjusting the spring tension of the device to vary the force effecting the forward feed movement of the belt so that it will accommodate differing size and weight objects.

These and other objects and advantages of this invention will be more readily apparent from the following description of the drawings in which.

Figure 5A:
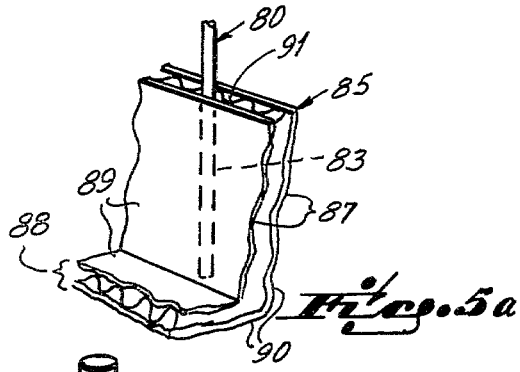
FIG. 5 is a perspective view of a shelf to which the invention of this application has been added but illustrated as being used to feed bottles forwardly on the shelf.
Figure 5:
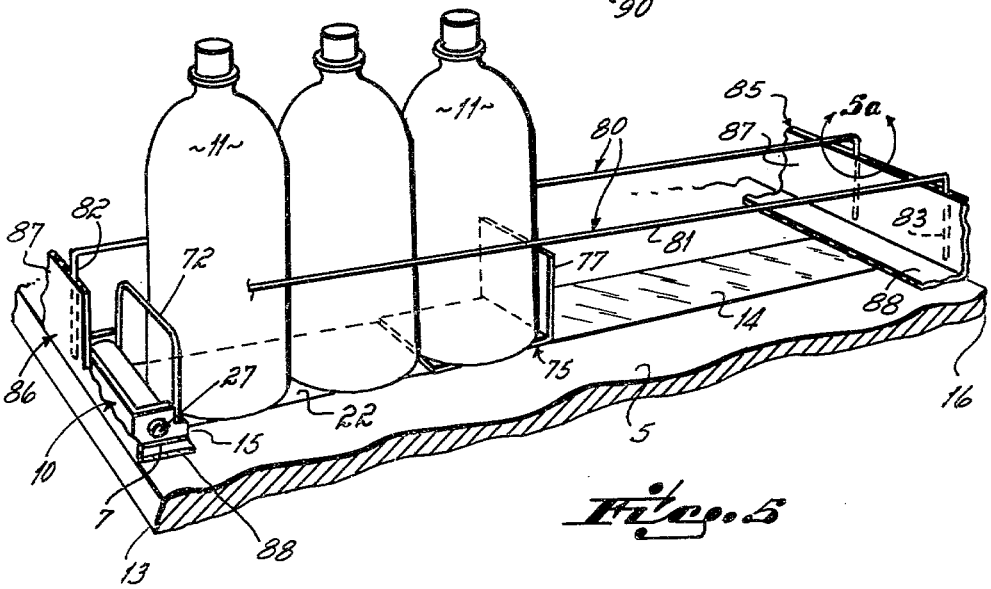
Figure 2:
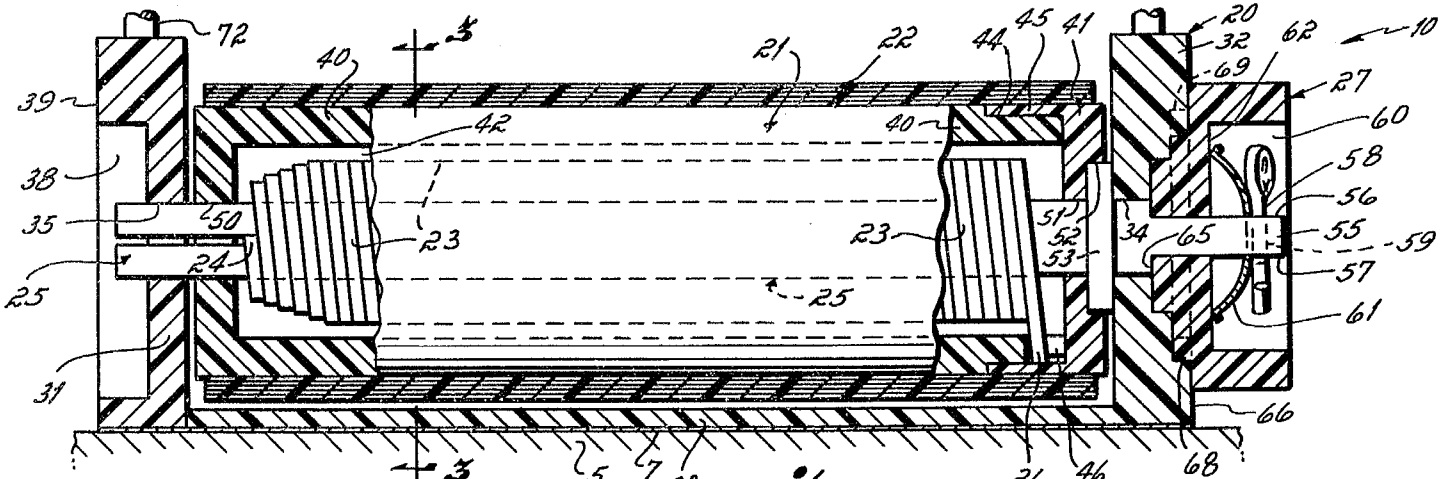
FIG. 2 is a cross sectional view through the forward feed device of this invention taken on line 2—2 of FIG. 1.

FIG. 5*a* is an enlarged fragmentary perspective view of the area enclosed by circle 5*a* of FIG. 5.

Figure 1:
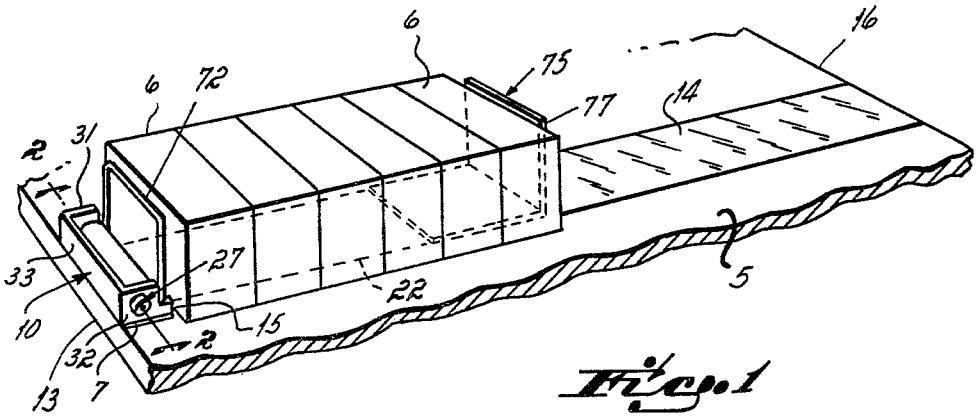
FIG. 1 is a perspective view of a shelf to which the invention of this application has been added to effect automatic forward feed of cartons forwardly on the shelf.

Referring first to FIG. 1, the forward feed display device 10 of this invention is illustrated as applied to a display shelf 5. As here illustrated, it is utilized to feed boxes 6, as for example, photographic film containing boxes, forwardly on the shelf 5 as the forwardmost box on the shelf is removed from the shelf. The same device 10 is illustrated in FIG. 5 as being used to feed bottles 11, as for example 64 ounce beverage bottles, forwardly on the shelf as the forwardmost bottles are removed. Manifestly though the device 10 has unlimited applications and may be utilized to feed any number of different types and styles of objects forwardly on a shelf.

In the preferred embodiment, the device 10 is secured to the top surface of the shelf 5 by a pressure sensitive adhesive 7. The mode of attachment of the device to the shelf though is not critical to the practice of the invention. Additionally, a low friction tape is adhered to the top surface of the shelf such that the tape 14 extends from adjacent the rearwardmost edge 15 of the device 10 rearwardly to the back edge 16 of the shelf. This tape preferably has a pressure sensitive adhesive secured to its underside and a low friction top surface, as for example Teflon, on its topside. When adhered to the top surface of the shelf, the tape 14 presents a very slick top surface over which a belt may slide with a minimum of friction.

The forward feed device 10 basically comprises a bracket 20 for rotatably supporting a roll 21 upon which there is wound a flexible belt 22. A torsion spring 23 is contained internally of the roll and is operable when the belt is unwound from the roll, to effect automatic rewinding of the belt onto the roll. This torsion spring is connected at one end 24 to a bracket supported shaft 25 and at the other end 26 to the roll 21. Mounted upon the end of the shaft 25 is a knob 27 by means of which the tension of the torsion spring 23 may be adjusted or varied to adjust or vary the force tending to pull the flexible belt 22 back onto the roll.

The bracket 20 is preferably molded in two pieces from plastic and comprises a base or bottom wall 30, a pair of end walls 31, 32 and a front wall 33. The end walls 31, 32 each have an axial aligned bore 34, 35 extending therethrough within which the shaft 25 is rotatably journalled. The end wall 31 is preferably recessed as indicated at 38 so that the end of the shaft 25 does not extend beyond the outer edge 39 of the end wall 31.

The roll 21 is also preferably manufactured from molded plastic. It comprises two pieces, a hollow cylinder 40 and an end cap 41. The cylinder 40 has a central cavity 42 within which the torsion spring 23 is located. It also has a peripheral recess 44 at one end over which a flange 45 of the end cap 41 is fitted. A slot 46 in the end of the cylindrical section 40 receives the end 26 of the torsion spring so as to secure that end 26 to the roll when the cap 41 is placed thereon.

There is an axial bore 50 in the end of the cylinder 40 coaxially aligned with the bore 35 in the end wall 31 of the bracket. There is also a counterbored aperture 51 in the center of the cap 41 coaxially aligned with the bore 34 in the end wall 32 of the bracket. The aperture or bore 51 is counterbored as indicated at 52 to receive a shoulder or flange 53 formed on the shaft 25.

One end 55 of the shaft 25 has flats 56, 57 formed thereon for the reception of the knob 27. This flattened end of the shaft receives a correspondingly shaped noncircular bore formed in the knob 27 such that the flats prevent relative rotation between the knob 27 and the shaft 55. Consequently, rotation of the knob effects rotation of the shaft 25. The knob 27 is retained on the shaft 25 by a cotter pin 58 which extends through a diametrical bore 59 in the shaft 25.

Figure 4:
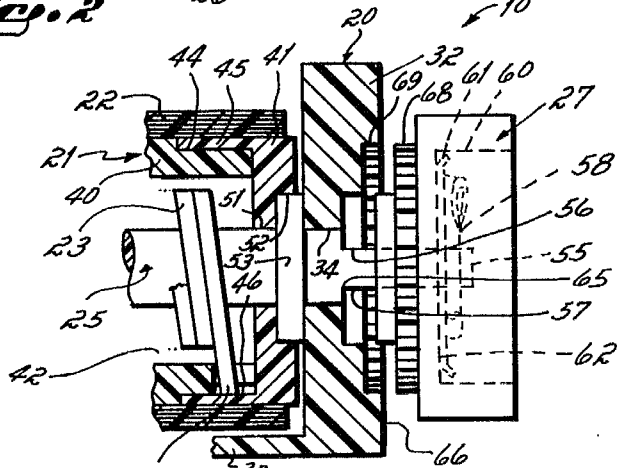
FIG. 4 is a cross sectional view of a portion of the device of FIG. 2, but in the position of the device which it assumes preparatory to adjusting the spring tension of the device.

The outer face of the knob 27 is recessed as indicated at 60 such that a flat leaf spring 61 may be inserted between the cotter pin 58 and the inner face 62 of the recess 60. The spring 61 and cotter pin 58 thus cooperate to retain the knob 27 biased against a shoulder 65 formed on the shaft 25 by the flats 56, 57. By compressing the spring, as illustrated in FIG. 4, the knob may be moved axially on the shaft 25 to the extent of the leaf spring 61 compression.

To retain the knob 27 against rotation when it is in contact with the outer face 66 of the end plate 32, the knob has a serrated boss 68 extending inwardly therefrom and engageable with a correspondingly shaped serrated recess 69 formed in the outer face 66 of the side plate 32. So long as the serrations of the boss 68 are engaged with the serrations of the recess 69 the knob cannot be rotated, but by moving the knob 27 away from the side plate 32 and thereby compressing the spring 61, the serrations 68, 69 may be disengaged so as to permit the knob and attached shaft 25 to be rotated (see FIG. 4).

Figure 3:
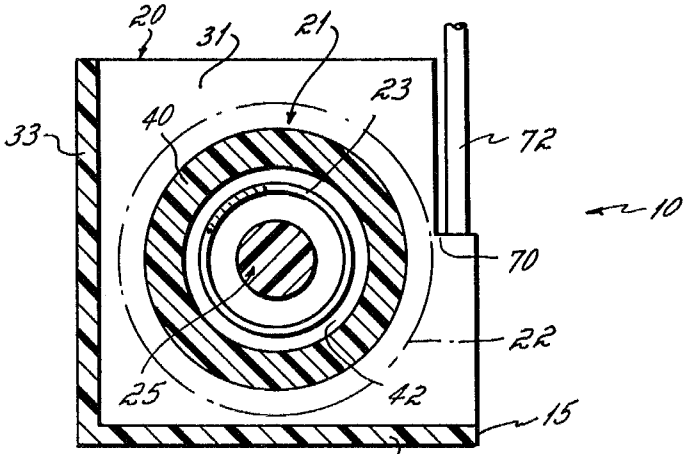
FIG. 3 is a cross sectional view taken on line 3—3 of FIG. 2.

Referring to FIGS. 1 and 3 it will be seen that the side plates 31, 32 are notched along their rear edge as indicated at 70. A generally U-shaped bale spring 72 has lower ends extending into vertical bores formed in notches 70 of the side plates 31, 32 such that the bale spring is supported from the side plates 31, 32. As explained more fully hereinafter this bale spring 72 forms a bumper surface for engagement with the forwardmost object on a shelf fed forwardly by the device 10 into contact with the bale spring.

Flexible belt 22 has its inner end adhesively secured to the peripheral surface of the roll 21. It is then wrapped around the roll and at its outer end has a generally L-shaped abutment plate 75 secured thereto. This abutment plate 75 is attached, as by an adhesive, to the top surface of the end of the belt 22.

In operation or use, the forward feed device 10 is attached to the top surface of a shelf 5 near the front edge 13 thereof. The low friction tape 14 is then secured to the top surface of the shelf 5, usually by a pressure sensitive adhesive applied to the underside of the tape. On the top surface of the tape 14 is the low friction material, as for example Teflon, over which the belt 22 may very easily slide with a minimum of friction. As an alternative to the use of the low friction top surface tape 14, the underside of the belt 24 may be coated with a low friction material, as for example Teflon, while the top surface is coated or maintained as a much higher friction material. In the preferred embodiment though the low friction surface is applied to the tape 14 which is adhered to the top surface of the shelf rather than to the underside of the belt 22.

The objects 6 to be fed forwardly on the belt 22 may then be placed between the bale 72 and the vertical leg 77 of the abutment 75. As more objects 6 are placed on the belt, the abutment 75 is caused to move away from the bale 72 and thereby to pull or strip the tape 22 from the roll 21. This pulling or stripping of the tape 22 from the roll causes the roll to rotate and in so doing, to cause the end 26 of the torsion spring 23 to move relative to the stationary shaft 25.

This rotational movement of the end 26 of the torsion spring relative to the stationary end 24 (which is retained stationary by the shaft 25) causes the spring 23 to be wound and tensioned, such that the torsion spring then maintains a force tending to pull the belt 22 back onto the roll. Consequently, the belt and the attached abutment are always biased back toward a position in which the abutment 75 contacts the bale 72.

In the event that it becomes important to increase the force tending to pull the belt back onto the roll, or to decrease it, as for example might be occasioned by the placement of heavier or lighter objects onto the belt, the spring force of torsion spring 23 is adjusted by knob 27. This is effected by pulling the knob axially to the position illustrated in FIG. 4 in which the serrations 68 are disengaged from the serrations 69. The knob may then be rotated so as to rotate the shaft 25 and thus the end 24 of torsion spring 23 so as to either increase or decrease the tension on the spring 23, depending upon the direction of rotation of the knob. After adjustment of that spring force, the knob 27 is released so that the leaf spring 61 will cause the knob 27 to move axially on the shaft 25 and thereby place the knob serrations 68 in engagement with the bracket serrations 69, thereby securing the shaft 25 against rotation relative to the bracket and consequently relative to the roller 21.

It will now be readily apparent that as the forwardmost object 6 is removed from the shelf 5, the belt 22 and attached abutment 57 will then be free to move toward the front of the shelf until such time as the forwardmost face of the next following object 6 engages the bale and is thereby restrained against further forward movement. This forward feeding of objects on the belt will continue until the abutment 75 at the end of the belt contacts the bale 72.

With reference now to FIG. 5 there is illustrated an identical forward feed device 10 as is illustrated in FIG. 1, but this time utilized to feed bottles 11 forwardly on a display shelf 5. When the forward feed device is used to feed cylindrical objects forwardly on a belt, which objects have a tendency to be pushed off of the belt and out of longitudinal alignment thereon, guide wires or so-called organizer wires 80 are usually secured on opposite sides of the tape 11 above the lateral edges of the tape so as to prevent any lateral movement of the bottles or objects off of the belt 22. To that end there is illustrated in FIG. 5 a device for supporting the organizer wires which is inexpensive, easily shipped, and less expensive than any device now being used for that purpose. Specifically, the organizer wires 80 are U-shaped wires having a longitudinally extending section 81 from which vertical sections 82 and 83 extend downwardly at the front and rear ends thereof. These vertical sections 82, 83 of the organizer wires are fitted into recesses of a corrugated sheet of material 85 located at the rear of the shelf, and another corrugated sheet of material 86 located at the front of the shelf. These sheets of corrugated material are generally slit or cut so that they may be bent into a right angle configuration having a horizontal section 88 secured to the top surface of the shelf and a vertical section 87 extending therefrom. The vertical sections 82, 83 of the organizer wires fit into the exposed corrugations in the vertical section 87 of the corrugated material.

In the preferred embodiment the corrugated material is double-face corrugated plastic. It comprises flat top and bottom sheets 89,90 of polyethylene between which a corrugated sheet 91 of polyethylene is sandwiched. Except for color, the corrugated plastic material resembles double-face corrugated cardboard.

The advantage of this particular type of corrugated device for securing the organizer wires at the front and back of the shelf is that it is a very inexpensive material which is readily adaptable to this use and which accommodates the organizer wires in any one of numerous different positions of adjustment by simply changing the corrugated slot within which the wire is located. Additionally, this arrangement of organizer wires and mounting devices 85, 86 has the advantage that when a multiplicity of such organizer wires are pre-assembled into the corrugated holding devices, the corrugated holding devices 85, 86 may be flattened to locate the horizontal and vertical legs 87, 88 in a common plane, and then the flattened corrugated devices placed in juxtaposition for shipment as a flattened assembled item.

To mount the organizer wires and holding device upon a shelf, the horizontally folded sections 88 of the front and rear members 85, 86 are simply adhered to the top surface of the shelf and the foward feed device 10 adhered to the top surface of the horizontal section 88 at the front end of the shelf. The result is a shelf 5 retrofitted with a forward feed device for automatically feeding columns of bottles 11 forwardly on the shelf as the forwardmost bottle 11 is removed from the column. By placing a series of forward feed devices 10 on a shelf with organizer wires located therebetween, it is possible to convert a complete shelf to a fully automatic one for automatically feeding multiple parallel columns of bottles or cans forwardly on the shelf.

While I have described only a single preferred embodiment of my invention, persons skilled in this art will appreciate numerous changes and modifications which may be made without departing from the spirit of my invention. Therefore, I do not intend to be limited except by the scope of the following claims:

I claim:

1. A display device for feeding a column of serially stacked objects on a shelf forwardly on the shelf as the forwardmost object in the column is removed from the shelf, said device comprising, a shaft, a roller mounted upon the shaft and adapted to be rotatably journalled at the front of a shelf, a flexible belt wrapped around said roller and secured at one end to said roller, abutment means secured to the opposite end of said belt, said abutment means being engageable with the rearwardmost object in the column of objects stacked on the belt and being moved away from said roller as additional objects are placed upon the belt, torsion spring means operable to effect automatic rewinding of said belt onto said roller and forward feed of said objects on said belt when the forwardmost object in the column of objects is removed from the belt, and variable means for adjusting the tension of said torsion spring means to vary the force with which said belt is moved forwardly on the shelf as objects are removed therefrom.

2. A display device for feeding a column of serially stacked objects on a shelf forwardly on the shelf as the forwardmost object in the column is removed from the shelf, said device comprising a shaft, a roller mounted over the shaft and adapted to be rotatably journalled at the front of a shelf, a flexible belt wrapped around said roller and secured at one end to said roller, abutment means secured to the opposite end of said belt, said abutment means being engageable with the rearwardmost object in the comumn of objects stacked on the belt and being moved away from said roller as additional objects are placed upon the belt, spring means operable to effect automatic rewinding of said belt onto said roller and forward feed of said objects stacked on said belt when the forwardmost object of the column of objects is removed from the belt, and variable means for adjusting the tension of said spring means to vary the force with which said belt is moved forwardly on the shelf as objects are removed therefrom.

3. The display device of claim 2 which further includes a low friction tape adhered to the top surface of the shelf to reduce the friction between the belt and the shelf.

4. The display device of claim 3 in which the tape is secured to the shelf by pressure sensitive adhesive.

5. The display device of claim 2 in which said shaft is mounted within a bracket.

6. The display device of claim 5 in which said bracket is secured to the shelf by pressure sensitive adhesive.

7. The display device of claim 2 which further includes a bracket adapted to be secured to the front of a shelf and said shaft rotatably journalled in said bracket, said roller being rotatably supported on said bracket, said spring means comprising a torsion spring, said torsion spring having one end secured to said rotatable shaft and the other end secured to said roller, and said spring tension adjusting means comprising a knob fixedly secured to the end of said rotatable shaft and engageable with said bracket to secure said shaft in different rotational positions so as to vary the tension on said torsion spring.

8. The display device of claim 7 which further includes a second spring means for biasing said knob into engagement with said bracket.

9. An attachment adapted to be secured to a display shelf for converting that shelf into one for automatically feeding a column of serially stacked objects on the shelf forwardly on the shelf as the forwardmost object in the column is removed from the shelf, said device comprising a bracket adapted to be removably secured to the front of a shelf, a shaft mounted within said bracket, a roller rotatably supported upon the shaft, a flexible belt wrapped around said roller and secured at one end to said roller, abutment means secured to the opposite end of said belt, said abutment means being engageable with the rearwardmost object in the column of objects stacked on the belt and being moved away from said roller as additional objects are placed upon the belt, spring means operable to effect automatic rewinding of said belt onto said roller and forward feed of said objects stacked on said belt when the forwardmost object in the column of objects is removed from the belt, and variable means for adjusting the tension of said spring means to vary the force with which said belt is moved forwardly on the shelf as objects are removed therefrom.

10. The display device of claim 9 which further includes a low friction tape adhered to the top surface of the shelf to reduce the friction between the belt and the shelf.

11. The display device of claim 10 in which the tape is secured to the shelf by pressure sensitive adhesive.

12. The display device of claim 9 in which said bracket is secured to the shelf by pressure sensitive adhesive.

13. The attachment of claim 9 in which said spring means comprises a torsion spring, said torsion spring having one end secured to said shaft and the other end secured to said roller, and said spring torsion adjusting means comprising a knob fixedly secured to the end of said rotatable shaft and engageable with said bracket to secure said shaft in different rotational positions so as to vary the tension on said torsion spring.

14. The display device of claim 13 which further includes a second spring means for biasing said knob into engagement with said bracket.

* * * * *